US005953794A

United States Patent [19]

Hanten et al.

[11] Patent Number: 5,953,794

[45] Date of Patent: Sep. 21, 1999

[54] MAGAZINABLE STRIP OF CLASPS OF FLEXIBLE TUBES AND BAGS

[75] Inventors: Jürgen Hanten, Rockenberg; Günter Vermehren, Usingen, both of Germany

[73] Assignee: Poly-Clip System Gmbh & Co., KG, Frankfurt am Main, Germany

[21] Appl. No.: 09/011,210

[22] PCT Filed: Jul. 2, 1996

[86] PCT No.: PCT/EP96/02937

§ 371 Date: Jan. 28, 1998

§ 102(e) Date: Jan. 28, 1998

[87] PCT Pub. No.: WO97/05031

PCT Pub. Date: Feb. 13, 1997

[30] Foreign Application Priority Data

Jul. 29, 1995 [DE] Germany ..... 195 27 876

[51] Int. Cl.[6] ..... B65D 63/00; B65D 77/00

[52] U.S. Cl. ..... 24/30.5 W; 24/20 R; 24/20 CW; 24/30.5 R

[58] Field of Search ..... 24/30.5 W, 30.5 R, 24/30.5 S, 20 R, 20 W, 20 CW, 20 S

[56] References Cited

U.S. PATENT DOCUMENTS

| | | | |
|---|---|---|---|
| 2,855,647 | 10/1958 | Smith | 24/30.5 W |
| 3,078,533 | 2/1963 | Allen | 24/30.5 W |
| 3,266,109 | 8/1966 | Thomas | 24/20 R |
| 3,503,119 | 3/1970 | Seitz, Jr. et al. | 24/30.5 W |
| 3,777,400 | 12/1973 | Klenz et al. . | |
| 4,097,967 | 7/1978 | Conner, Jr. | 24/30.5 R |
| 4,166,571 | 9/1979 | Niedecker | 24/30.5 W |
| 4,380,096 | 4/1983 | Nishida et al. | 24/20 R |
| 5,495,645 | 3/1996 | Suzuki et al. | 24/30.5 R |

FOREIGN PATENT DOCUMENTS

| | | | |
|---|---|---|---|
| 0228276 | 3/1959 | Australia | 24/30.5 W |
| 1560606 | 2/1980 | United Kingdom | 24/20 R |

*Primary Examiner*—Victor N. Sakran

*Attorney, Agent, or Firm*—Sprung Kramer Schaefer & Briscoe

[57] ABSTRACT

A magazinable strip of sealing clips (10) for bags and tubes, whose individual clips each consist of a clip bottom (14) and two legs (16, 18) and are connected with each other at the ends of the legs, is formed such that the sealing clips (10) are widest adjacent the clip bottom (14), and the width of the adjoining legs (16, 18) of two adjacent sealing clips (10) unilaterally decreases to less than half the maximum width alternatingly towards the one and the other longitudinal side.

The longitudinal sides (32", 34") of the two legs (16", 18") resting against each other upon closure of the sealing clip can have locking teeth which restrict a springing back of the legs of the sealing clip when the same has been closed.

1 Claim, 2 Drawing Sheets

MAGAZINABLE STRIP OF CLASPS OF FLEXIBLE TUBES AND BAGS

This invention relates to a magazinable strip of sealing clips for bags and tubes, whose individual clips each consist of a clip bottom and two legs and are connected with each other at the ends of the legs.

Strips of sealing clips as stated above generally consist of an originally flat basic section which for the purpose of being processed by means of automatic closing devices is formed to a strand of succeeding U-shaped individual clips. For closing a bag or tube, the same is gathered to form a tip and is inserted in a U-shaped sealing clip, which is separated from the strip. Then, the sealing clip is closed by bending the two legs of the U-shaped sealing clip toward each other. In the process, the free ends of the legs abut against each other and are upset. A description of such a closing operation and of sealing clips in accordance with the prior art can be found in DE-PS 37 15 626.

A great disadvantage of these known sealing clips consists in the fact that the cross-section of the tube or bag gathered to form a tip must lie within relatively close limits, to ensure both a safe and a tight closure. When the cross-section of the tip is too large, the free ends of the legs cannot abut against each other, and the bag or tube is not safely closed. On the other hand, when the cross-section of the tip is too small, the two legs of the sealing clip have already been upset to a maximum before the tip has been compressed completely, so that the bag or tube cannot be closed tightly. Moreover, the closing forces acting during closure are relatively great.

To eliminate this disadvantage, the width of the legs of the sealing clips was countercurrently reduced towards the free ends, so that after the closing operation the legs partly lie beside each other. From the U.S. Pat. No. 2,855,647 it is known to hold the individual clips thus formed in a self-adhesive way one behind-each other on a flexible conveyor belt, so as to make them magazinable. Another solution is disclosed in DE-GM 1 960 244; in this reference, the individual clips hang on each other in the area of the bottom and must be separated from each other at an angle to the longitudinal direction of the strip. In the commonly used automatic closing devices neither the one nor the other clips can be employed; in addition, their manufacture is much more expensive than that of the above-described strips of clips.

It is therefore the object of the invention to provide a strip of sealing clips whose individual clips adhere on each other at the ends of the legs, but are suited for a wide range of different tip cross-sections.

This object is solved by a strip of sealing clips of the above-stated type, whose sealing clips are widest adjacent the clip bottom, and the width of the adjoining legs of two adjacent sealing clips between their ends on the side of the clip bottom and their ends connected with each other unilaterally decreases to less than half their maximum width, where the decrease in width in strip direction is alternatingly provided towards the one and towards the other longitudinal side.

The trick of alternatingly providing the unilateral tapering of the leg width along the strip, so that sealing clips of different forms or in a different arrangement are always succeeding each other, provides for the production of magazinable strips of sealing clips adhering on each other at the ends of their legs even with those sealing clips as they were known in principle from the U.S. Pat. No. 2,855,647. When processing such a strip of sealing clips the consequence is, however, that the joint between the legs of one and the same clip, which were placed beside each other during the closing operation, alternatingly includes another angle of inclination with the longitudinal axis of the casing tip in succeeding clips, which is, however, unproblematic.

By means of the sealing clips of the strip in accordance with the invention bags or tubes gathered to form a tip of various diameters can be closed; the sausage tips may differ in their diameter by about 40%. In addition, the forces required for closing are only half as great in the inventive clip as in the prior art. A further advantage consists in that the strips of sealing clips are very easy to manufacture; the saving of material is about 25% as against conventional strips of sealing clips.

One variant of the sealing clips consists in that the legs have a constant width adjacent their free end. In this way it is possible to increase the area on which the legs of a closed sealing clip laterally overlap each other, so that the range in which the tip cross-sections may vary also becomes even larger.

In the sealing clips of the inventive strip of sealing clips the two legs of a sealing clip might, however, spring back as soon as the forces applied by the automatic closing device on the sealing clip decrease, which is due to the elasticity of the material of the sealing clip and the forces which the tip material enclosed by the sealing clip applies on the sealing clip. This springing back can lead to an undesired untightness. To reduce such undesired untightness, all sealing clips where the longitudinal sides of two legs laterally rest against each other when the sealing clip has been closed, as this is the case in the inventive sealing clips, but also in known sealing clips, may be provided with locking teeth on the corresponding longitudinal sides to restrict the springing back of the legs of the sealing clip when the same has been closed. In this case, the legs of the sealing clips can only spring back until their locking teeth mesh with each other.

Embodiments of the sealing clip in accordance with the invention will now be explained with reference to the drawing, wherein.

Figure 6:
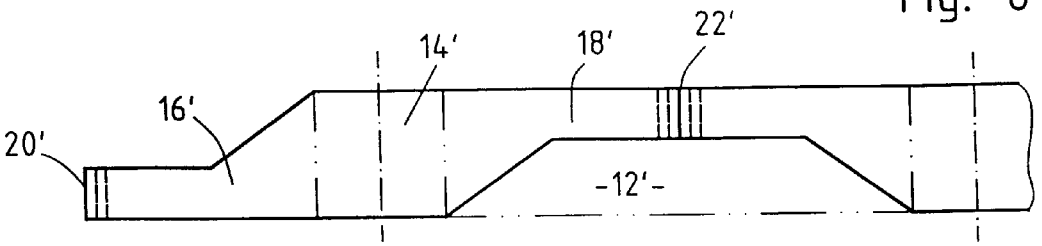
FIG. 6 shows a variant of the layout of the strip of sealing clips in accordance with FIG. 1.

The starting material for manufacturing a sealing clip in accordance with the invention is a deformable strip of constant width and thickness. Alternatingly, V-shaped sections 12 are punched out of this material, so that the sealing clips 10 adhering on each other provide the layout of a strip of sealing clips shown in FIG. 1. FIG. 6 shows that the sections 12 need not necessarily be V-shaped. In the layout (FIG. 1, FIG. 6) it can be seen that each sealing clip 10 substantially consists of a clip bottom 14, from whose sides two legs 16 and 18 extend, which from the clip bottom 14 towards their ends 20 and 22 are continuously tapering unilaterally and on various longitudinal sides of the sealing clip 10 to less than half their maximum width. Each leg 16 and 18 thus has a parallel longitudinal side 28 and 30, respectively, and an inclined longitudinal side 32 and 34, respectively, with respect to the center line of the strip-shaped starting material. At the ends 20 and 22 of the legs 16 and 18 connecting webs 24 and 26 are provided, at which the sealing clips 10 adhere on each other.

After the punching operation, the strip is bent in an automatic bending machine to form U-shaped sealing clips 10. In the embodiment shown in FIG. 2 the clip bottom 14 remains flat during bending, whereas the legs 16 and 18 are standing upright. The connecting webs 24 and 26 laterally extend from the legs 16 and 18, so that all adjoining sealing clips 10 of a strip are open in the same direction (in FIG. 2: in upward direction).

Figure 2:
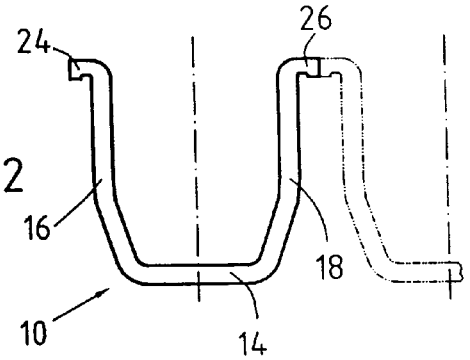
FIG. 2 shows the strip section of FIG. 1 in a front view.
Figure 3:
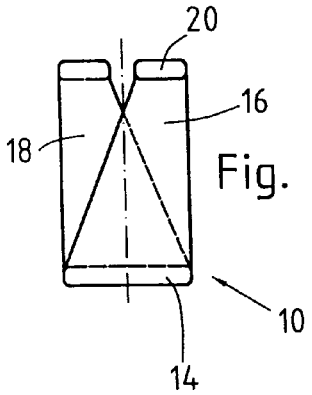
FIG. 3 shows a sealing clip of the strip in a side view.

FIG. 3 clearly shows that the opposing legs 16 and 18 of the U-shaped sealing clips in accordance with FIG. 2 alternatingly taper from the clip bottom 14 to the ends 20 and 22 of the legs.

Figure 4:
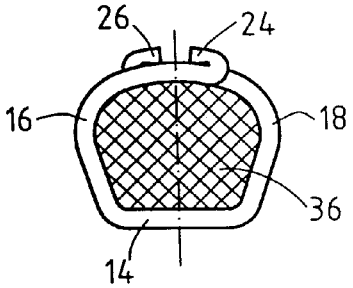
FIG. 4 shows a sealing clip closed about a tip in a front view.
Figure 5:
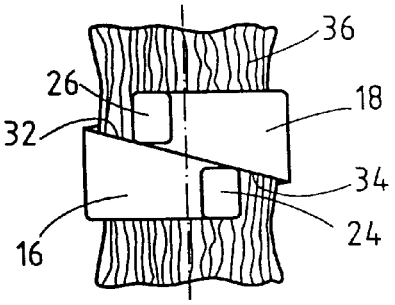
FIG. 5 shows the closed sealing clip of FIG. 4 in a top view.

When closing the sealing clip 10, its connecting webs 24 and 26 do not bluntly abut against each other, but are guided past each other, so that the section shown in FIG. 2 is formed into the section shown in FIG. 4. The sealing clip 10 completely surrounds a tip 36. The top view in accordance with FIG. 5, which represents the closed sealing clip in accordance with FIG. 4, shows that the legs 16 and 18 rest against each other with their inclined longitudinal sides 32 and 34 and safely close the tip 36 even when the legs 16 and 18 are urged apart by the enclosed tip 36 or slightly spring back after closure due to their elasticity.

The exact shape of the sealing clip 10 after closure depends on the enclosed tip diameter: When the same is very large, the inclined longitudinal sides 32 and 34 of the legs 16 and 18 are not in contact with each other; nevertheless they overlap each other laterally, so that the tip is safely closed. When the tip diameter is very small, on the other hand, the legs 16 and 18 move along each other during closure over a large part of their length; at the same time the entire sealing clip 10 and in particular the clip bottom 14 becomes twisted. The inclined longitudinal sides 32 and 34 of the legs 16 and 18 are then pressed against each other after closure by spring forces resulting from the twisting of the sealing clip 10.

As has already been described, the sections 12 alternatingly punched out during the manufacture of a strip of sealing clips need not necessarily be V-shaped. When the sections 12'—as shown in FIG. 6—have another shape, the legs 16' and 18' have a constant width at their ends, so that the diameters of the tip cross-sections may vary over an even larger range. In the extreme case, the sections may even be rectangular.

Figure 1:
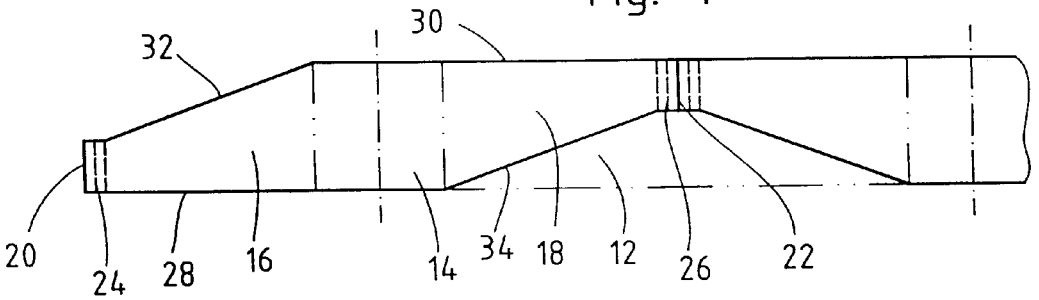
FIG. 1 shows a top view of a partial layout of a strip of sealing clips.

In the sealing clip in accordance with FIG. 6 in contrast to the sealing clip in accordance with FIG. 1 no twisting occurs when tips of a particularly small diameter should be closed, because the mutually parallel end portions of the legs 16' and 18' can smoothly be moved past each other during closure. The legs 16' and 18' contact each other only laterally after closure, when the width of their end portions is just half the largest width of a sealing clip.

Figure 7:
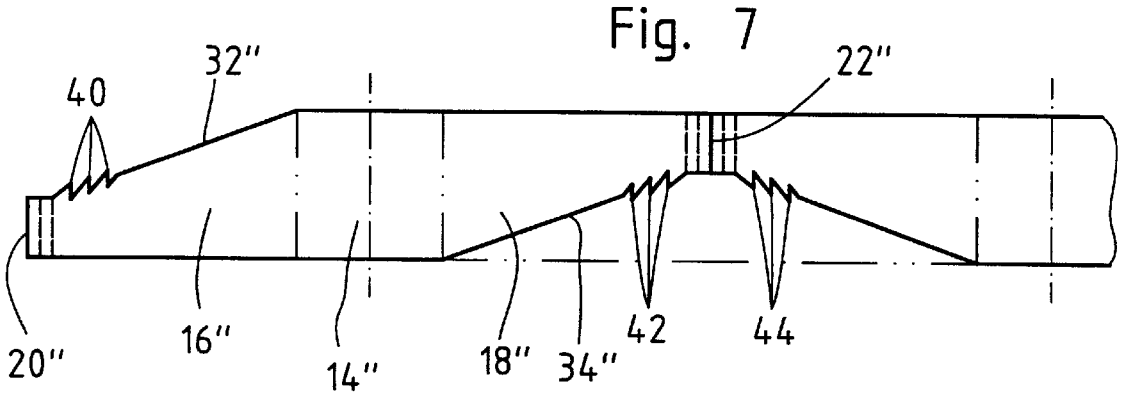
FIG. 7 shows a further variant of the layout of a strip of sealing clips in accordance with FIG. 1 with locking teeth.
Figure 8:
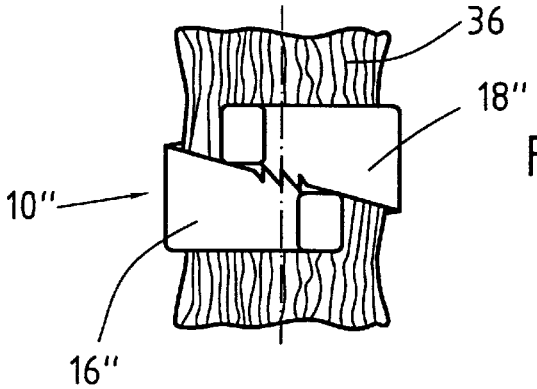
FIG. 8 shows a closed sealing clip in accordance with FIG. 7 in a top view.

The sealing clip represented in the layout in accordance with FIG. 7 in contrast to the sealing clip shown in FIG. 1 additional has locking teeth 40, which act against an opening of the closed sealing clip. The locking teeth 40 are each provided adjacent the ends 20" and 22" of the legs 16" and 18" at those longitudinal sides which rest against each other when the clip is closed, as this is shown in FIG. 8. The locking teeth 40 each comprise locking surfaces 42 and sliding surfaces 44. The locking surfaces 42 extend about vertical to the center line of the strip material from which the sealing clips 10" were made. The sliding surfaces 44 have a flatter angle with respect to this center line than the locking surfaces 42 and together with the same form locking teeth 40 inclined in the direction of the clip bottom 14 of the sealing clip 10".

Just as during the closure of the sealing clips in accordance with FIGS. 1 to 6, the inclined portions 32"/34" of the sealing clip in accordance with FIG. 7 move past each other during closure. This leads to the fact that even the locking teeth 40 of the two legs 16" and 18" move past each other with at least a part of their sliding surfaces 44. Upon closure, the sliding surfaces 44 of the two legs 16" and 18" then partially rest against each other. When directly after closure the force decreases with which the automatic closing device acts on the sealing clip 10", the legs 16" and 18" of the sealing clip 10" tend to spring back due to their elasticity and the force applied by the tip 36 on the sealing clip 10". During this springing back, at least some of the locking surfaces 42 of the two legs 16" and 18" move towards each other until they rest against each other. As soon as at least some of the locking surfaces 42 rest against each other, the legs 16" and 18" cannot spring back further, and the sealing clip 10" cannot open further. The condition shown in FIG. 8 is reached.

We claim:

1. A magazinable strip of sealing clips for bags and tubes, whose individual clips each consist of a clip bottom and two legs and which are connected to each other at the ends of the legs, wherein the sealing clips (10) are widest adjacent the clip bottom (14), and the width of the adjoining legs (16, 18) of two adjacent sealing clips (10) between their ends on the side of the clip bottom and their ends (20, 22) connected with each other unilaterally decreases to less than half their maximum width, where the decrease in width is alternatingly provided toward the one and toward the other longitudinal side in the strip direction and wherein over partial lengths the legs (16', 18') have a constant width at their ends (20', 22') connected with each other.

* * * * *